United States Patent [19]

Lübbers et al.

[11] 4,210,555

[45] Jul. 1, 1980

[54] PROCESS FOR THE GENERATION OF DENSE CLOUDS FOR CAMOUFLAGE PURPOSES

[75] Inventors: Willi Lübbers, Trittau; Uwe Krone, Hamfelde Krs. Stormarn, both of Fed. Rep. of Germany

[73] Assignee: Nico-Pyrotechnik Hanns-Juergen Diederichs KG., Trittau, Fed. Rep. of Germany

[21] Appl. No.: 919,987

[22] Filed: Jun. 28, 1978

[30] Foreign Application Priority Data

Jun. 22, 1977 [DE] Fed. Rep. of Germany ..... 2729055

[51] Int. Cl.[2] ..... C09K 3/30

[52] U.S. Cl. ..... 252/305; 102/6; 102/65; 102/66; 102/90

[58] Field of Search ..... 252/305; 102/6, 65, 102/66, 90

[56] References Cited

U.S. PATENT DOCUMENTS 2,103,807 12/1937 Willing ..... 102/67 X 3,402,667 9/1968 Tarpley, Jr. et al. ..... 102/65

FOREIGN PATENT DOCUMENTS 1454258 11/1976 United Kingdom .

OTHER PUBLICATIONS

Abstract of "Fluorescent and Carcinogenic Smoke--Producing Compositions", O. G. vol. 668, pp. 540-541, (Mar. 10, 1953), Jack DeMent.

*Primary Examiner*—E. Suzanne Parr

[57] ABSTRACT

There is disclosed a process for the generation of a dense cloud, as for the purpose of camouflage. Finely divided solid particles are discharged for a container, as by means of compressed gas, the solid particles being in the form of a microfine powder having a particle diameter of up to 60 μm and being impenetrable to visible light and infra-red light of up to 14 μm wave-length and having a settling velocity of up to 5 cm/sec. The powders used are talc, kaolin, calcium carbonates, magnesium carbonates, sodium hydrogen carbonates or other free-flowing powders or powders that have been rendered flowable, which form buoyant clouds upon being dispersed as by atomization.

4 Claims, No Drawings

PROCESS FOR THE GENERATION OF DENSE CLOUDS FOR CAMOUFLAGE PURPOSES

The invention relates to a process for the generation and rapid discharge of dense clouds for camouflage purposes. It is known to raise a fog-wall, protecting against enemy observation, in front of the armored vehicle by launching mortar smoke bodies from grenade launchers, mounted on tank-turrets.

Pyrotechnic smoke compositions, based on phosphorus, phosporus-containing compositions, or HC smoke compositions, used in mortar smoke bodies, generate a fog consisting of finely divide acid droplets or hydroscopic salts, such as zinc chloride, (West German Patent Specification No. 1,185,510, West German Patent Specification No. 1,196,548 and West German Patent Specification No. 1,300,454). Furthermore, it is known to generate fog-clouds by the discharge of strongly hygroscopic acids, such as chlorosulphonic acid, or of acid chlorides, such as phosphorus pentachloride, or of liquids, such as titanium tetrachloride, or of mixtures of the above-mentioned acids, acid chlorides or liquids in combination with amines, such as, for example, triethylamine as disclosed in the West German Unexamined Patent Application (Offenlegungsschrift) No. 2,232,763.

Furthermore, it is known to generate fog-clouds with fine droplets by dispersing oil or oil/water emulsions by means of compressed gas generators.

While fire risk, risk of poisoning by the usually toxic fog, and only low scattering and absorption in the near infra-red range are generally inherent in pyrotechnic fogs, the acid fogs, acid chloride fogs, liquid fogs and two-component fogs, produced from the latter types with amines, possess, apart from only low scattering and absorption in the near infra-red range, above all, the disadvantage of acute chemical attack, corrosion and toxicity. In addition, the oil fogs or oil/water emulsion fogs are completely permeable to the wave length range of the near infra-red light, (0.8 to 14 μm). Moreover, it is known from the British Patent Specification 638,060 to produce a stream of solid particles in the form of smoke for coating and finishing purposes.

The present invention has among its objects the generation of dense clouds which can be rapidly discharged and are cold, neutral and non-toxic as well as impermeable to the rays of an infra-red instrument or of other temperature entropy recording instruments used in military night vision techniques.

The invention is carried out for military purposes by using microfine powder, having a particle diameter of from 3 to 60 μm, being impenetrable to visible light and infra-red light of up to 14 μm wave length, and having a settling velocity of up to 5 cm/sec., which is dispersed in a very short time from a container by means of a propellant gas or explosive.

Powders that can be used in practising the invention are talc, kaolin, ammonium sulphate, ammonium phosphates, calcium carbonates, magnesium carbonates, sodium hydrogen carbonate, and other free-flowing powders, or powders that have been rendered flowable, which can form buoyant clouds upon being dispersed as by discharge of a compressed gas.

By the use of the above-mentioned neutral, cold and non-toxic powders, the disadvantages of toxicity and of fire risk are excluded, as the powder is finely atomized in the cold. The essential advantage, however, is that military night vision techniques, particularly the use of temperature entropy recording instruments, are unable to penetrate the artificial dust cloud and thus are unable to record a temperature entropy diagram of the terrain behind the cloud. Dispersion of the powder can be effected by known methods by means of propellant gas, e.g. $CO_2$, $N_2$ or compressed air, inside or outside the receptacle containing the powder. Similarly, it is also possible to apply as the propellent a gas refrigerant gas or a propellent gas from gas generators. Release or liberation of the compressed gas onto the powder in the container is preferably effected electrically, e.g. by operating a pyrotechnic power element or an electrical-mechanical element.

Ejection of the powder is effected through an atomizer-like device having an ascending tube in the interior of the powder container, such tube ending in a suitable nozzle aperture for the fine division or dispersion of the powder into the surrounding atmosphere. In accordance with the usual technique, separation between the release of compressed gas onto the powder and the efflux of the powder through the nozzle can be accomplished, for example, by means of an additional valve and/or a bursting-disc on the container. In this way, rapid and safe discharge of the fog-cloud is possible.

Although the invention is described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. Process for the generation of a dense cloud for camouflage purposes, comprising discharging and dispersing from a container finely divided solid particles in the form of a microfine powder, the particles having a diameter from 3 to 60 μm and being impenetrable to visible light and infra-red light of up to 14 μm wavelength, the particles having a settling velocity of up to 5 cm/sec.

2. A process according to claim 1, wherein the particles are discharged from the container and dispersed by means of compressed gas.

3. A process according to claim 1, wherein the powders used are talc, kaolin, calcium carbonates, magnesium carbonates, sodium hydrogen carbonates which have been rendered flowable, which form buoyant clouds on atomization.

4. A composition for generating dense clouds for camouflage purposes, consisting essentially of finely divided solid particles in the form of microfine powder, said particles being selected from powders of talc, kaolin, calcium carbonates, magnesium carbonates and sodium hydrogen carbonates, the particles having a diameter from 3 to 60 μm and being impenetrable to visible light and infra-red light of up to 14 μm wavelength, said microfine powder being rendered flowable by being discharged and dispersed from a container by means of compressed gas.

* * * * *